US005547371A

United States Patent [19]

Rose

[11] Patent Number: 5,547,371

[45] Date of Patent: Aug. 20, 1996

[54] VARIABLE TORCH APPARATUS

[76] Inventor: M. Fred Rose, 115 Madrona Ave., Belvedere, Calif. 94920

[21] Appl. No.: 517,770

[22] Filed: Aug. 22, 1995

[51] Int. Cl.[6] ..... F23D 3/24

[52] U.S. Cl. ..... 431/320; 362/161

[58] Field of Search ..... 431/320, 291, 431/295; 362/159, 161

[56] References Cited

U.S. PATENT DOCUMENTS 653,617 7/1900 Climenson et al. ..... 362/161

2,503,496 4/1950 Kawasniewski ..... 431/320

4,477,247 10/1974 Kumasaka ..... 431/320

5,205,730 4/1993 Capdeville ..... 431/320

*Primary Examiner*—Carroll B. Dority

*Attorney, Agent, or Firm*—Larry D. Johnson

[57] ABSTRACT

A collection of components which may be assembled into a variety of home, garden and patio-type torch configurations includes a torch portion having a fuel canister and a wick element, a vertical support or pole portion, and a base portion. The apparatus is preferably constructed from standard copper plumbing pipe and associated copper fittings.

10 Claims, 2 Drawing Sheets

VARIABLE TORCH APPARATUS

BACKGROUND OF THE INVENTION

1. Field of the Invention

This invention relates generally to house, patio and garden decorative hardware, and more specifically to an improved apparatus enabling variable constructions for garden and patio-type torches.

2. Description of the Prior Art

Garden and patio-type torches are well known and in widespread use. Typically, these patio torches consist of a small canister containing a flammable fuel such as lamp oil or kerosene, with a wick element protruding from the canister which is lit for use. The fuel canister is usually supported some height above the ground on a rigid pole which is inserted into the ground. One or a number of such torches may be positioned around a garden or patio for a pleasant lighting and aesthetic effect.

However, these known patio torch assemblies are of a single (fixed) configuration, and are therefore difficult to customize and adapt for use in other applications, such as for placement on a tabletop, or for producing more than one torch flame per assembly. In addition, these known patio torch assemblies are of relatively weak construction, and prone to breakage.

SUMMARY OF THE INVENTION

The variable torch apparatus of this invention provides a collection of readily available components which may be assembled in a variety of ways to construct numerous home, garden and patio-type torch configurations. The basic collection of components of the inventive apparatus includes a torch portion having a fuel canister and a wick element, a vertical support or pole portion, and a base portion. These portions may be assembled together in an essentially infinite number of ways to yield traditional outdoor-type patio torches, table-top torches, or other configurations, of any desired height, and in single or multiple torch flame embodiments.

The inventive torch apparatus is preferably constructed from standard copper plumbing pipe and associated copper fittings. The copper pipe and fittings are assembled and may be soldered together to create an attractive garden/patio-type torch which may be used in the traditional manner for illumination and aesthetics, and/or may be used as an insect repellant device (e.g., when burning a torch fuel such as citronella). The use of this readily available copper plumbing pipe material results in a strong, virtually permanent fixture that will weather and age to yield a copper green patina, or which may be coated with a clear covering to maintain its original shiny copper finish. Alternatively, the fixture material can be painted or otherwise colored into any other color, such as green, black, brown, or yellow.

The inventive apparatus thus yields a torch fixture that is totally self-contained, sturdy, and long-lasting. It can be customized by the user to fit in any location, and can even be disassembled and reconstructed into the same or a different configuration if desired.

DETAILED DESCRIPTION OF A PREFERRED EMBODIMENT

Figure 1:
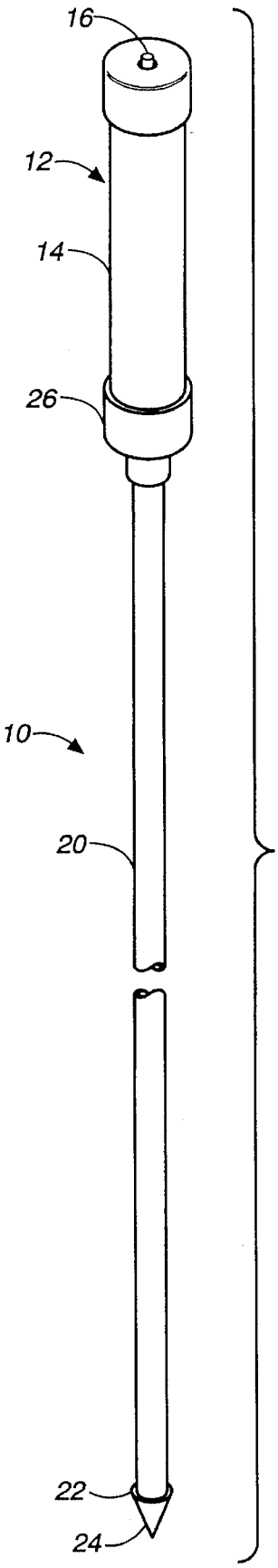
FIG. 1 is a fragmented perspective view of an outdoor-type patio torch embodiment of the variable torch apparatus of this invention, illustrating the basic components of the apparatus including a torch portion having a fuel canister and wick element, a vertical support or pole portion, and a base portion.

FIG. 1 is a fragmented perspective view of an outdoor-type patio torch embodiment 10 of the variable torch apparatus of this invention, illustrating the components of the apparatus including a torch portion 12 having a fuel canister 14 and wick element 16, a vertical support or pole portion 20, and a base portion 22 (here, just a cone or point 24). The torch portion 12 is preferably constructed of an approximately eight inch length of one and one-fourth inch copper pipe, which has been capped and sealed as described infra. The torch portion is attached to the pole portion 20, an approximately six foot length of one-half inch copper pipe, by a one and one-fourth inch to one-half inch copper reducer 26 forming the bottom of the torch portion 12 fuel canister 14. The various parts are preferably soldered together to form a strong construction (e.g., to seal the bottom of the fuel canister), but some of the parts may be simply friction-fit together for ease in disassembly (e.g., to connect the torch portion to the pole portion).

The length of the resultant outdoor-type patio torch is approximately six to seven feet, with a pointed base that is easily inserted in the ground or in a dirt-filled garden pot. The base may be inserted into the ground to different depths to alter the height of the flame and enhance the visual effect, or to spread the insect repellant smoke at different levels (e.g., feet, waist and head).

Figure 1A:
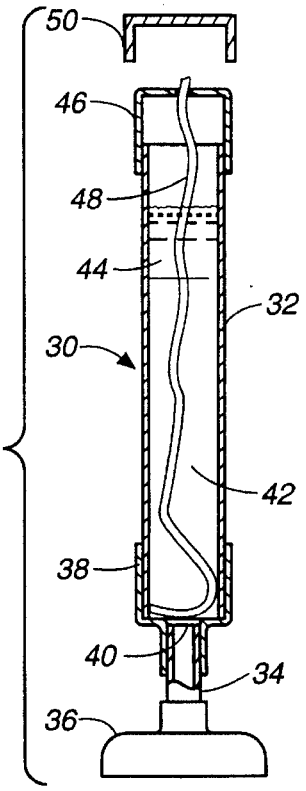
FIG. 1*a* is a side elevation view in partial cross-section of a tabletop-type torch embodiment of the variable torch apparatus of this invention, again illustrating the components of the apparatus including a torch portion, a vertical support or pole portion, and a base portion.
Figure 2:
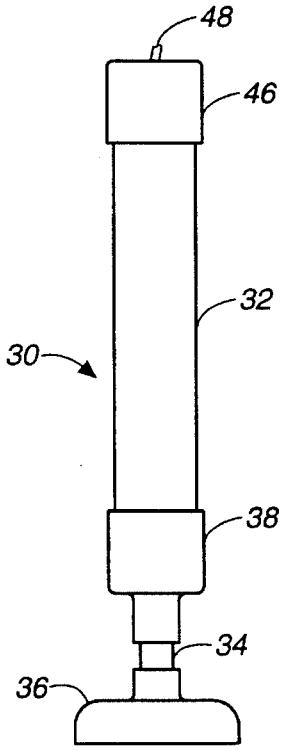
FIG. 2 is a side elevation view of the tabletop-type torch embodiment of FIG. 1A.

FIG. 1*a* is a side elevation view in partial cross-section of a tabletop-type torch embodiment 30 of the variable torch apparatus of this invention, while FIG. 2 is a side elevation view of the tabletop-type torch embodiment 30 of FIG. 1A. These views again illustrate the basic components of the apparatus including a torch portion 32, a (shortened) vertical support or pole portion 34, and a base portion 36.

Torch portion 32 is again constructed from an eight inch by one and one-fourth inch segment of copper pipe which is plugged near the base of the reducer 38 with a soldered copper plug 40. This creates a vessel or fuel canister 42 to contain the torch fluid 44 (e.g., citronella). The torch portion is capped with a standard one and one-fourth inch copper cap 46 that has been drilled to accommodate a wick 48 of approximately ten inches in length. The wick 48 is fitted through the copper cap 46 and the cap is placed (but preferably not soldered) on the fuel canister 42. The wick extends into the fuel canister and absorbs the fuel 44. The wick is then lit and will burn for approximately three to four hours without refilling. Extinguishing cap 50 (e.g., a one and one-half inch copper cap) may be placed over the wick to extinguish the flame when desired, and may also be used to reduce fuel evaporation when the torch assembly is not in use.

In this embodiment, the base portion 36 consists of an inverted two inch to one-half inch copper reducer, which may be soldered or friction-fit to the pole portion. Alternatively, a two inch copper cap or other component may be used, and soldered to the pole portion if necessary.

Figure 3:
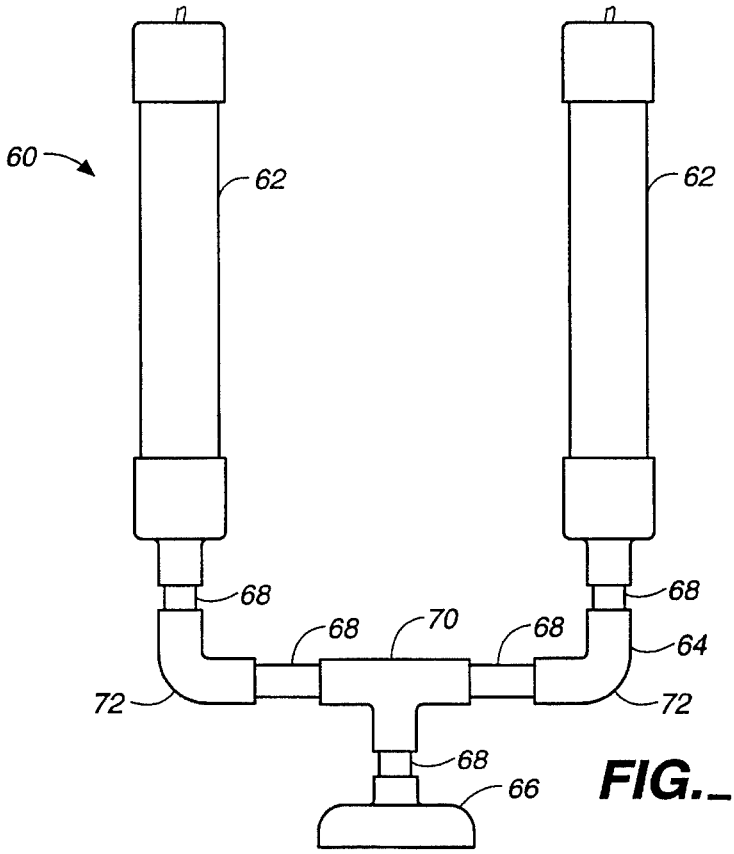
FIG. 3 is a side elevation view of an alternate version of a tabletop-type torch embodiment of this invention, this version having a pair of torch portions supported on a single split or manifold pole portion and terminating in a single base portion.

FIG. 3 is a side elevation view of an alternate version 60 of a tabletop-type torch embodiment of this invention, this version having a pair of torch portions 62 supported on a single split or manifold pole portion 64 and terminating in a single base portion 66. The torch portions 62 and base portion 66 are as described supra. The manifold pole portion 64 consists of several short segments 68 of one-half inch copper pipe, connected by a one-half inch copper pipe tee 70 and two one-half inch copper pipe elbows (ninety-degree connectors) 72.

Figure 4:
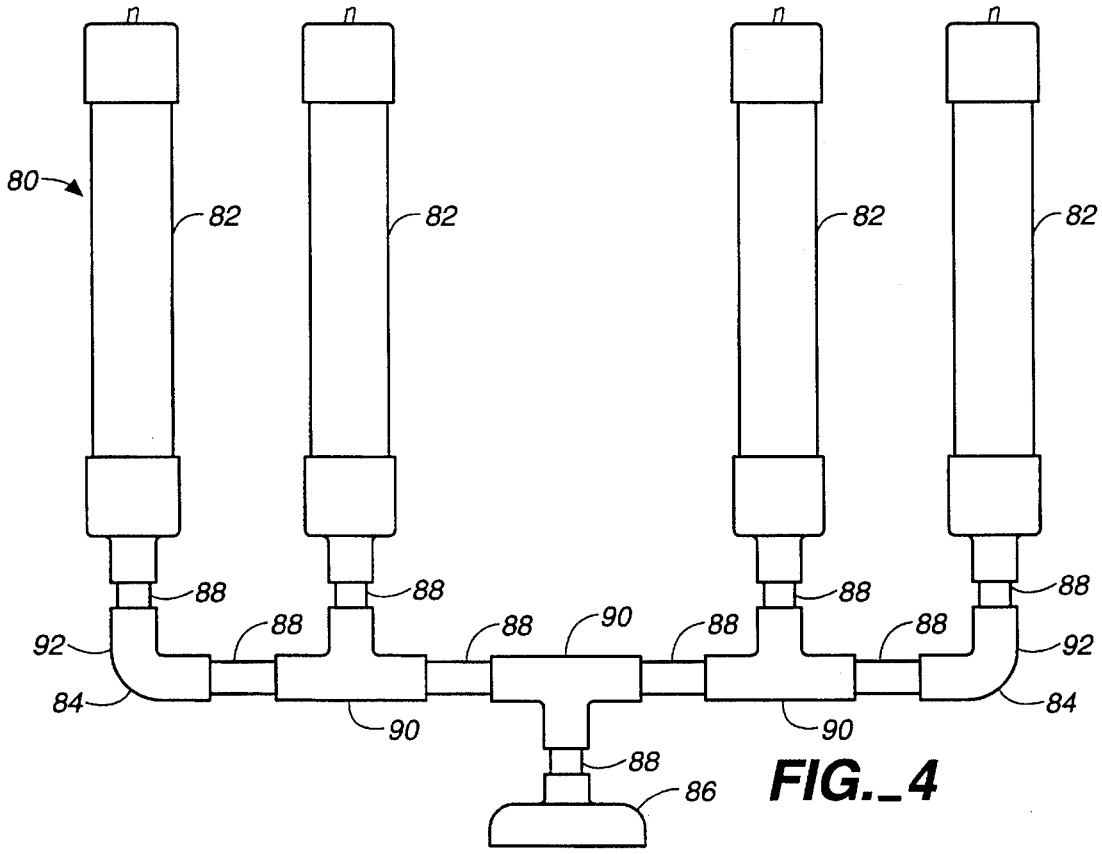
FIG. 4 is a side elevation view of a further alternate version of a tabletop-type torch embodiment of this invention, this version having two pairs of torch portions each supported on a single split or manifold pole portion and again terminating in a single base portion.

FIG. 4 is a side elevation view of a further alternate version 80 of a tabletop-type torch embodiment, this version having two pairs of torch portions 82 supported on a pair of split or manifold pole portions 84 and again terminating in a single base portion 86. The torch portions 82 and base portion 86 are again as described supra. The manifold pole portions 84 consist of several segments 88 of one-half inch copper pipe, connected by three one-half inch tees 90 and two one-half inch elbows 92.

These views help to illustrate the variety of configurations that can be achieved using the basic components (torch, vertical support, and base) of the inventive apparatus. While the torch portion may be fairly consistent, the vertical support or pole portion may vary from a full length of six feet or more (for a patio-type torch) to a nominal length of one inch or less (for a tabletop-type torch). The base portion may simply be a point or even simply the terminal end of the pole portion (for a patio-type torch), or may be a more substantial inverted cap or reducer having a diameter preferably greater than the torch portion for stability (for a tabletop-type torch). Finally, the vertical support or pole portion may be split into two or more "branches" to form a manifold to support a plurality of torch portions, which may be at equal or differing heights. All of these variations and more result from the combination of the three basic components.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A variable torch apparatus comprising:

a torch portion having a fuel canister and wick element, said torch portion constructed of a segment of copper pipe which has been capped and sealed;

a vertical support portion constructed of a length of copper pipe and attached to said torch portion by a copper pipe reducer element; and a base portion connected to said vertical support portion, said base portion constructed of copper pipe material.

2. The variable torch apparatus of claim 1 wherein said copper pipe reducer element forms the bottom of said torch portion fuel canister.

3. The variable torch apparatus of claim 1 wherein said vertical support portion is approximately six feet in length.

4. The variable torch apparatus of claim 1 wherein said base portion comprises a point.

5. The variable torch apparatus of claim 1 wherein said base portion comprises an inverted copper pipe reducer element.

6. The variable torch apparatus of claim 1 wherein said torch portion is constructed from a segment of copper pipe which is plugged with a soldered copper plug to create a vessel to contain torch fluid.

7. The variable torch apparatus of claim 1 wherein said torch portion is capped with a copper cap that has been drilled to accommodate a wick.

8. The variable torch apparatus of claim 1 wherein said vertical support portion comprises a manifold member adapted to support a plurality of torch portions.

9. The variable torch apparatus of claim 8 wherein said manifold member terminates in a single base portion.

10. The variable torch apparatus of claim 8 wherein said manifold member comprises a plurality of short segments of copper pipe connected by a copper tee and copper elbow.

* * * * *